US005693264A

United States Patent [19]

Fricke

[11] Patent Number: 5,693,264

[45] Date of Patent: Dec. 2, 1997

[54] PORTABLE WORKING TOOL WITH INTERNAL COMBUSTION ENGINE

[75] Inventor: Gerd Fricke, Waiblingen, Germany

[73] Assignee: Andreas Stihl, Waiblingen, Germany

[21] Appl. No.: 689,992

[22] Filed: Aug. 16, 1996

[30] Foreign Application Priority Data

Aug. 18, 1995 [DE] Germany ..... 195 30 374.1

[51] Int. Cl.[6] ..... F02M 1/02

[52] U.S. Cl. ..... 261/64.6; 123/179.18

[58] Field of Search ..... 261/64.6; 123/179.18

[56] References Cited

U.S. PATENT DOCUMENTS

| | | | |
|---|---|---|---|
| 4,304,737 | 12/1981 | Breckenfeld et al. | 261/64.6 |
| 5,174,255 | 12/1992 | Collins et al. | 261/64.6 |
| 5,215,049 | 6/1993 | Wolf | 261/64.6 |
| 5,485,814 | 1/1996 | Tuggle et al. | 123/179.18 |

FOREIGN PATENT DOCUMENTS 4120876 12/1992 Germany .

*Primary Examiner*—Tim R. Miles

*Attorney, Agent, or Firm*—Robert W. Becker & Associates

[57] ABSTRACT

A portable working tool such as a motor chainsaw has a housing and an internal combustion engine with a carburetor contained in the housing. A throttle valve is connected to the carburetor. A choke flap is connected to the carburetor upstream of the throttle valve in the flow direction of the combustion air into the carburetor. An operating member is connected to the choke flap. A choke flange is connected to the carburetor at a side of the carburetor at which the choke flap is arranged. A suction member for the combustion air is connected to the choke flange. The choke flange has a receiving element for the operating member. A lever is fixedly connected to the choke flange. The operating member has a first end extending through the housing to the exterior and a second end engaging the lever. An actuating button is connected to the first end.

22 Claims, 6 Drawing Sheets

Fig. 2
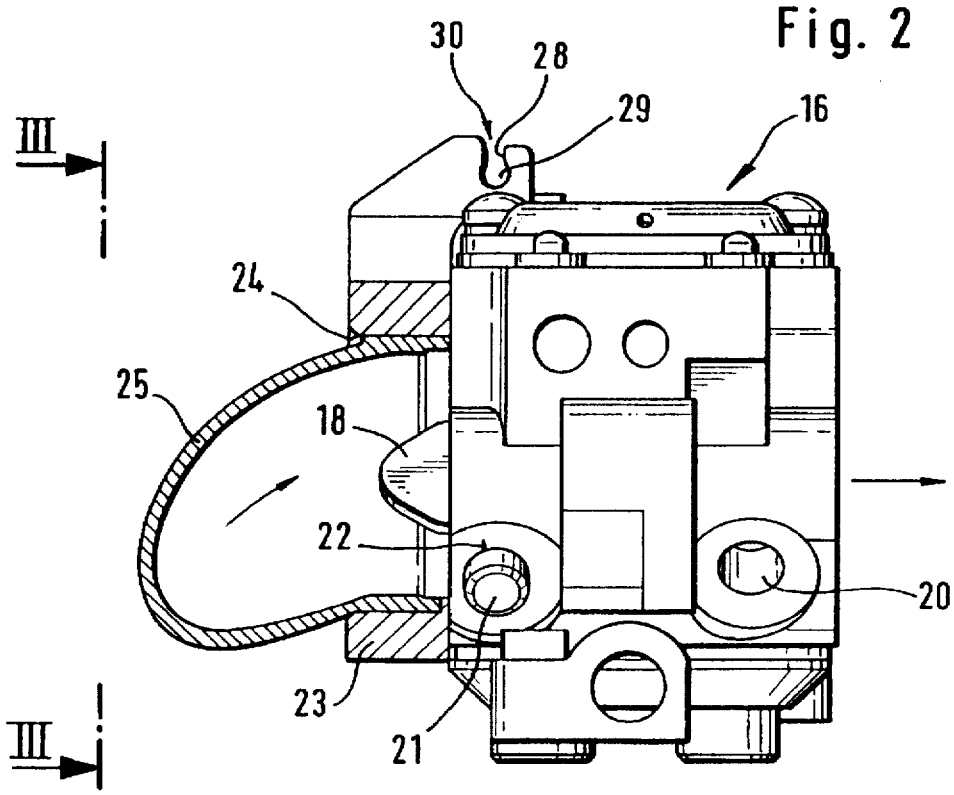
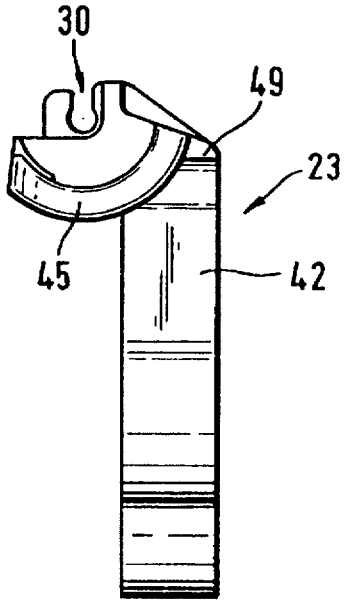
Fig. 7
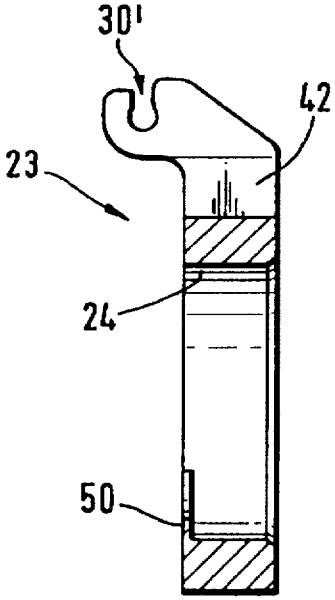
Fig. 9

XI

PORTABLE WORKING TOOL WITH INTERNAL COMBUSTION ENGINE

BACKGROUND OF THE INVENTION

The present invention relates to a portable working tool, especially a motor chainsaw etc., with an internal combustion engine comprising a carburetor and a throttle valve connected to the carburetor. A choke flap is connected to the carburetor upstream of the throttle valve in the flow direction of the combustion air into the carburetor.

From German Offenlegungsschfrift 41 20 876 a motor chainsaw is known in which a housing contains an internal combustion engine. For handling the motor chainsaw the housing is provided with an upper grip and a lateral grip whereby at the upper grip a throttle lever and a throttle lever lock are provided. The throttle lever is connected via a linkage with a throttle valve positioned within the carburetor so that the throttle valve can be actuated with the aid of the throttle lever. The carburetor is furthermore provided with a choke flap which is actuated with an operating lever and a corresponding transmission linkage, positioned between operating lever and choke flap. These components are also arranged within the upper grip. The throttle valve functions as a starting aid whereby the actuating member is provided in the forward area of the upper grip in order to be easily reached by the operator. In this design the carburetor is located within the rearward area of the grip so that a defined spatial arrangement including the kinematic for the transmission linkage is provided. The transmission linkage between the actuating member and the choke flap comprises, however, a plurality of parts and levers forming the starter linkage so that a considerable expenditure for manufacturing and mounting is required.

It is therefore an object of the present invention to provide a working tool of the aforementioned kind in which the number of components required for actuating the choke is substantially reduced and with which the construction and assembly are substantially simplified.

SUMMARY OF THE INVENTION

The portable working tool according to the present invention is primarily characterized by:

A housing;

An internal combustion engine, comprising a carburetor, contained in the housing;

A throttle valve connected to the carburetor;

A chock flap connected to the carburetor upstream of the throttle valve in a flow direction of the combustion air into the carburetor;

An operating member connected to the choke flap;

A choke flange connected to the carburetor at a side of the carburetor at which the choke flap is arranged;

A suction member for the combustion air connected to the choke flange;

The choke flange having a receiving element for the operating member;

A lever fixedly connected to the choke flange;

The operating member having a first end extending through the housing to the exterior and a second end engaging the lever;

An actuating button connected to the first end.

Advantageously, the receiving element is comprised of two shaft bearings spaced from one another and having a common bearing axis, wherein the bearing axis extends parallel to a face of the choke flange.

Preferably, the operating member is a wire bracket formed by bending a wire.

Advantageously, the second end is hook-shaped.

Preferably, the first end is bent and the actuating button is comprised of plastic material and is connected positive-lockingly to the first end.

In a preferred embodiment of the present invention, the wire bracket has a longitudinal axis and is pivotable about the longitudinal axis into two defined positions, wherein the working tool comprises securing elements for securing the wire bracket in the two defined positions.

In another embodiment of the present invention, the securing elements are arranged in the vicinity of the actuating button and are comprised at at least one non-elastic cam with a glide surface and at least one elastic bracket, wherein the elastic bracket slides along the glide surface of the cam.

Preferably, the cam is stationary.

The cam is preferably fixedly connected to the choke flange.

Advantageously, the cam and the choke flange are molded as a unitary part.

In yet another embodiment of the present invention, the elastic bracket and the actuating button are formed as a unitary part, the elastic bracket being an elastic tongue.

Preferably, the elastic bracket has a base with which the elastic bracket is connected to the actuating button. The cam has a forward end. The base has an abutment surface for the forward end of the cam.

Preferably, the securing elements are arranged at the second end and comprise at least one cam with oppositely extending slanted surfaces.

The working tool preferably further comprises a bracket to which the cam is connected. The bracket acts as a spring in the direction of the longitudinal axis of the wire bracket.

In a further embodiment of the present invention, the choke flange, the receiving element, and the bracket with the cam form together a unitary part comprised of plastic material.

Advantageously, the bracket has a curved portion and the second end, when the choke flap is in a rest position, is received in the curved portion without mechanical loading of the bracket.

Preferably, in an actuated position of the choke flap, the second end is positioned on one of the oppositely extending slanted surfaces adjacent to the dead center position of the cam.

In a preferred embodiment of the present invention the suction member is a suction tube. The choke flange has a receiving opening and the suction tube is axially pressed into the receiving opening for securing the suction tube to the choke flange.

Preferably, the choke flange has a radially inwardly extending abutment connected to the inner circumference of the receiving opening at a side of the choke flange facing the carburetor.

Expediently, the abutment is an annular segment extending over an angular distance of less than 180°.

Advantageously, the choke flange has at least two bores for receiving fastening screws.

Preferably, the choke flange consists of polymethylene oxide and the working tool further comprises support sleeves inserted into the bores. The support sleeve consists preferably of a material that is of much greater hardness than polymethylene oxide.

The major advantages of the present invention are that for the choke actuation a very low number of transmission members is required which can be manufactured in a simple manner and which are easy to mount. Furthermore, the receiving element for supporting the operating member serves at the same time also for its positioning.

According to a preferred embodiment of the invention the receiving element for the operating member is in the form of two shaft bearings which are axially aligned with one another whereby the bearing axis extends parallel to the plane of the choke flange. In this manner it is possible to provide two short bearing sections having a relatively great spacing to one another. This results in an exact guiding of the operating member so that a displacement relative to the longitudinal axis can be prevented.

The operating member is preferably in the form of a wire bracket which can be manufactured in a simple and thus inexpensive manner. The one end of the operating member is hook-shaped and engages an opening of the lever of the choke flap. Since the hook-shaped end is moved about a radius relative to the longitudinal axis of the bracket along a circular arc segment, the opening within the lever of the choke flap is embodied as a slotted hole so that a jamming of the parts is prevented. The actuating button is preferably a plastic part that is snapped onto the bent second end of the bracket and is positive-lockingly, especially form-fittingly, secured thereat. Inasmuch as the operating member is comprised of plastic material, it is, of course, possible to produce the actuating button and the operating member as a unitary part of the same plastic material.

Since the choke flap conventionally is positionable only into two or three predetermined positions, whereby the rest position corresponds to the non-activated, i.e., open choke flap, it is expedient to provide means with which the bracket can be positioned in at least two defined positions by pivoting about its longitudinal axis. This ensures that the choke flap will not be in a position that is disfavorable for the operation of the internal combustion engine. In an especially preferred manner, the means for securing the defined positions are provided in the area of the actuating button and comprise a non-elastic cam as well as an elastic bracket. The elastic bracket glides along the cam surface across the zenith (dead center) of the cam so that on either side of the cam, slanted away from the zenith, two defined positions are formed.

The non-elastic cam is expediently connected to a stationary component of the carburetor, preferably at the choke flange whereby a one-part construction is advantageous. The elastic bracket is preferably in the form of a spring-elastic tongue and, for example, formed as a unitary part of the actuating button. Alternatively, the means for securing the defined positions can also be provided at the area of the hook-shaped end and may comprise at least one cam with oppositely extending slanted surfaces.

In order to ensure that the operating member is stationary with respect to the direction of its longitudinal axis and can perform only a rotational movement, it is advantageous to arrange the cam at a bracket which is embodied as a spring acting on the operating member in the longitudinal direction of the pivot axis. In this manner, the cam during pivoting of the hook-shaped end can retract in response to the actuating force, but is returned into the initial position as soon as the hook-shaped end does no longer exert a force.

According to a preferred embodiment of the invention, the choke flange is made of plastic material, preferably polymethylene oxide (POM). The shaft bearings as well as the bracket with the elastically secured cam can easily be formed as a unitary part together with the choke flange of POM. The bracket is preferably provided with a curved portion engaged by the hook-shaped end in the rest position, i.e., when the choke flap is non-activated, without mechanical loading of the spring. In this manner, the plastic material of the spring-elastic bracket is loaded only for very short periods of time so that fatigue of the material is prevented.

The choke flap should be movable from the actuated position with a force that is smaller than the force required for moving it from the rest position into the actuated position so that, for example, after completed start-up of the engine, the choke flap no longer remains in the actuating position. For this purpose, it is expedient that in the actuating position of the choke flap the hook-shaped end is positioned at a location which is adjacent to the dead center of the cam on the respective adjacent slanted surface. Since in the actuated position the actuating button at the operating member is positioned such that it projects substantially from the contour of the housing, the operator can simply return the operating member into the rest position without having to move his hand away from the lateral grip.

The suction member for the combustion air is preferably in the form of a suction tube and is fastened at the choke flange by axially pressing it into an opening of the choke flange. In this manner, additional fastening means are not required and this results in a simplification of the mounting operation. At the end of the opening facing the carburetor, the choke flange is provided with a radially inwardly extending abutment whereby the suction tube is inserted into the opening until it reaches this abutment. In this manner, the depth of the insertion of the tube into the opening is defined so that the connection of the tube with the choke flange is reliably sealed. At the same time, it is prevented that the end of the suction tube extends into the range of movement of the choke flap where it could impede the function of the choke flap.

A reliably functioning and dimensionally stable as well as simple design of the abutment is provided when it is in the form of an annular segment having an angular distance of less than 180°. The choke flange is preferably connected to the carburetor with screws. For this purpose it is expedient to provide the choke flange with at least two openings for receiving fastening screws whereby into these openings support sleeves consisting of a material that is of much greater hardness than the material of the choke flange are inserted. Thus, the pressing forces transmitted from the screws onto the choke flange are limited by the support sleeves.

BRIEF DESCRIPTION OF THE DRAWINGS

The object and advantages of the present invention will appear more clearly from the following specification in conjunction with the accompanying drawings, in which:

FIG. 2 shows a diaphragm carburetor with a suction tube for the combustion air;

FIG. 7 shows a view according to arrows VII of FIG. 5;

FIG. 9 shows a section along the line IX—IX of FIG. 5;

DESCRIPTION OF PREFERRED EMBODIMENTS

The present invention will now be described in detail with the aid of several specific embodiments utilizing FIGS. 1 through 11.

Figure 1:
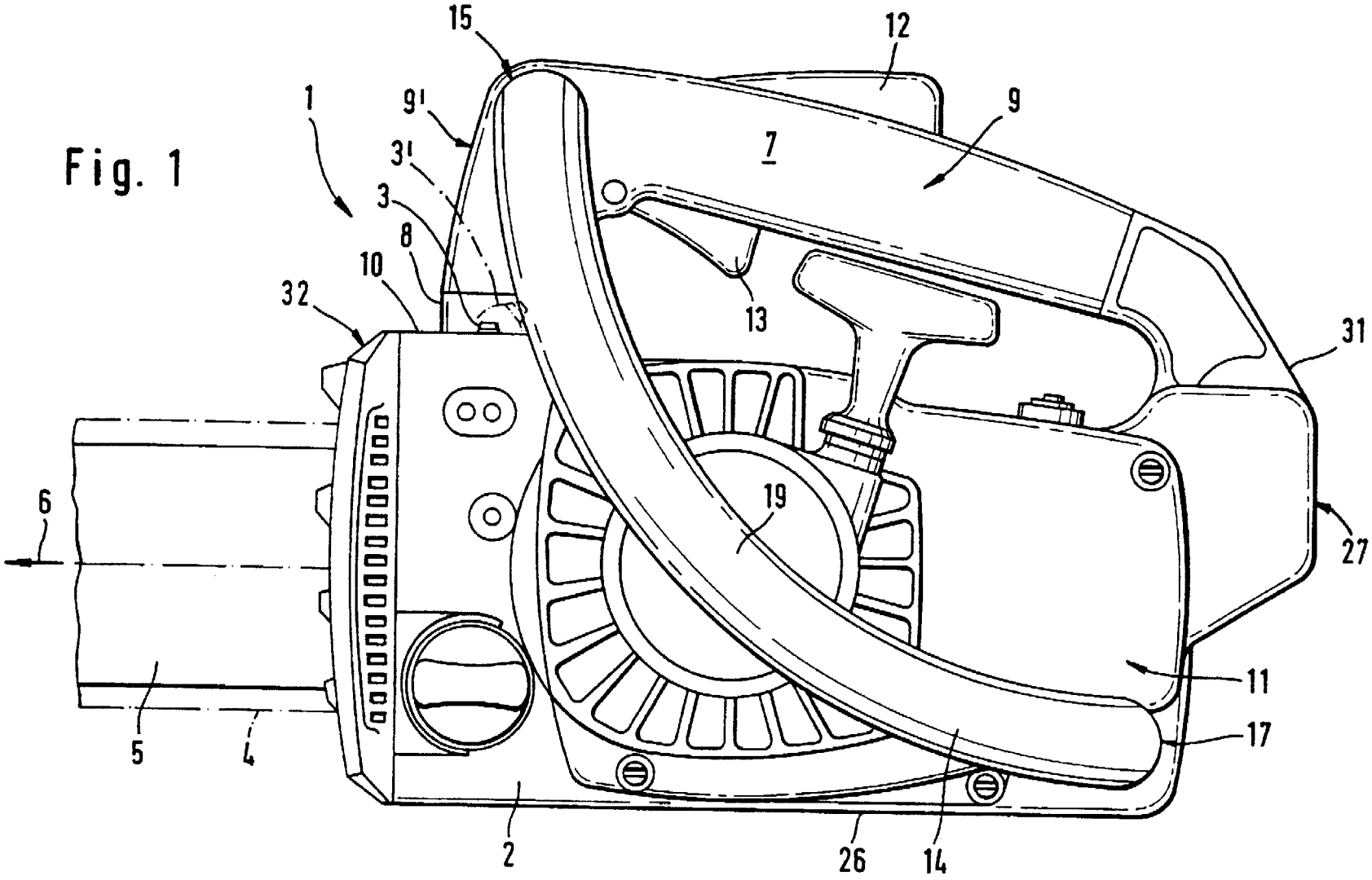
FIG. 1 is a motor chainsaw in a schematic perspective view.

The motor chainsaw 1 represented in FIG. 1 comprises a housing 2 with an internal combustion engine arranged therein, for example, a two-stroke combustion engine that drives a saw chain 4 running on a chain guide 5. The housing 2 has a bottom side 26 which is also a support surface for resting the motor chainsaw 1. In this position of the motor chainsaw the plane of the chain guide rail 5 is perpendicular to the ground. An upper side 10 is positioned opposite the bottom side 26. A grip 7 extending in the longitudinal direction 6 of the motor chainsaw above the center of gravity of the motor chainsaw is connected to the upper side 10. The grip 7 has a central portion 9 where a throttle lever 13 and a throttle lever lock 12 for actuating the motor are provided. The grip 7 has a first end 8 with which it is connected in the area of the forward housing section 32 facing the guide rail 5 to the upper side 10 of the housing 2. The second end 31 of the grip 7 is connected to the rearward housing section 27 facing away from the guide rail 5.

For holding and guiding the working tool with both hands a lateral bracket or grip 14 is arranged at the longitudinal side 11 of the housing 2. Its first end 15 is connected in an area neighboring the forward grip section 9' to the grip 7. The lateral grip 14 extends along the longitudinal side 11 over the entire constructive height of the housing 2 and is connected with a second end 17 in the area of the bottom side 26 of the housing 2 to the lateral side of the housing. Between the ends 15 and 17 a center section 19 of the lateral grip 14 extends which is positioned at a distance parallel to the lateral side 11 of the housing 2. The second end 17 of the lateral grip 14 is connected in the area of the rearward housing section 27 facing away from the chain guide 5 so that the lateral grip 14 extends approximately over the entire height as well as over a greater portion of the length of the housing 2, Adjacent to the first end 8 an actuating button 3 for the choke flap of a carburetor of the internal combustion engine is positioned. The the actuating button 3 in its rest position projects only slightly past the upper side 10 of the housing 2. In the actuating position of the choke flap, the actuating button 3 is in the position 3' represented in a dashed line and is thus at a higher lever below the upper end 15 of the lateral grip 14. In this manner, the actuating button 3 can be moved into another predetermined position by the operator guiding the motor chainsaw 1 without the operator having to remove his hand from the upper end 15 of the grip 14. Accordingly, the handling safety of the motor chainsaw 1 is thus not impaired with respect to actuating the choke flap and especially upon returning it into the rest position.

FIG. 2 represents a diaphragm carburetor 16 having arranged within the air channel a throttle valve and a choke flap 18. The throttle valve which is not represented in FIG. 2 is positioned in the vicinity of the downstream side of the carburetor 16 in a bore 20 while the choke flap 18 is positioned at the upstream side of the carburetor and is supported with the choke flap shaft 21 in a bore 22. At the upstream side a choke flange 23 is connected to the carburetor 16 which has a center opening 24 in which is received the end of a suction tube 25. The end of the suction tube 25 is pressed into the central opening 24 of the choke flange 23 and in this manner is positive-lockingly as well as sealingly connected to the choke flange. The choke flange 23 comprises at the upper side a shaft bearing 30 whereby the bearing axis extends parallel to the plane of the choke flange 23. The shaft bearing 30 is formed by a circular bore 29 which opens in the upward direction with a radially extending opening 28 having a width that is smaller than the diameter of the bore 29.

Figure 3:
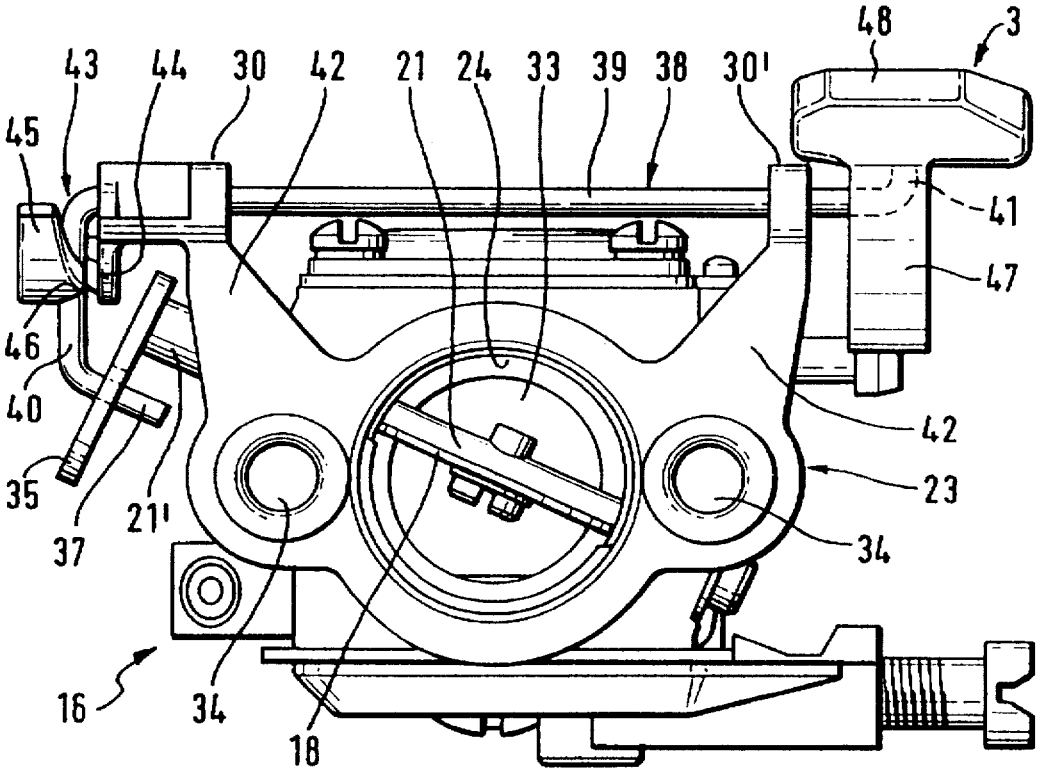
FIG. 3 shows a view according to arrows III of FIG. 2 without suction tube but with choke actuation.

FIG. 3 shows a view in the direction of arrows III in FIG. 2 without suction tube but with choke actuating mechanism. Upstream of the carburetor 16 a choke flange 23 is arranged which comprises a central opening 24 which is aligned with a suction channel 33 of the carburetor 16. For attaching the choke flange 23, screws (not represented in the drawing) are provided which extend through corresponding bores 34 of the choke flange 23 into the housing of the carburetor 16. In the suction channel 33 a choke flap 18 is positioned which is fastened to the choke flap shaft 21. The choke flap 18 in the normal operation of the motor chainsaw is in the position represented in FIG. 3 in which the cross-sectional area of the suction channel 33 is as great as possible.

The choke flap shaft 21 is provided with an end piece 21' external to the carburetor housing 16 and has connected to its end a lever 35. As can be seen especially in the perspective view of the actuating mechanism for the choke flap 18 in FIG. 4, the lever 35 comprises a slotted hole 36. An angled section 37 of a hook-shaped end 40 which is a component of the operating member 38 engages the slotted hole 36. The operating member 38 is a wire bracket 39 formed from a wire and comprising an elongate central portion as well as a hook-shaped end 40 and a further bent end 41 to which is connected the actuating button 3 preferably such that a form-locking or positive-locking connection is produced.

Figure 4:
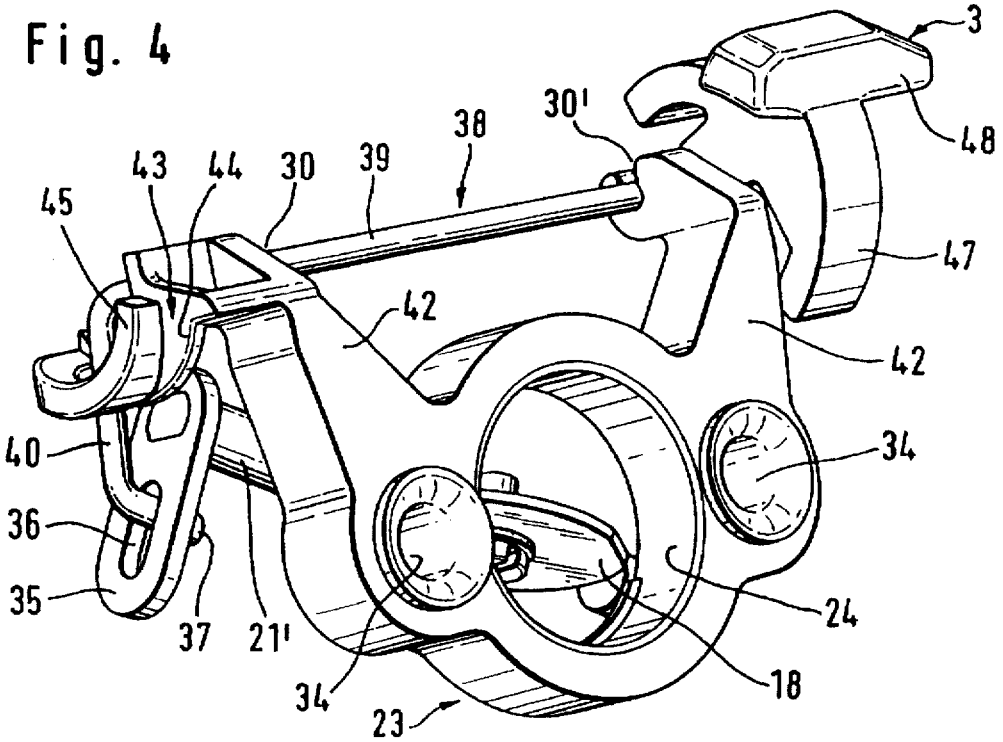
FIG. 4 shows a perspective view of the actuating mechanism for the choke.

As can be seen in FIGS. 3 and 4, the wire bracket 39 of the operating member 38 is received in shaft bearings 30, 30' which are arranged at the arms 42 of the choke flange 23. The shaft bearings 30, 30' are formed as a unitary part with the arms 42 and the choke flange 23 whereby this component is preferably made of polyacetal. The two shaft bearings 30, 30' are positioned at a possibly greatest axial distance to one another so that even for a minimal axial extension of the individual shaft bearings 30, 30' an extremely exact guiding of the bracket 39 without risking a deflection from the longitudinal axis results.

Adjacent to the shaft bearing 30 a slot-shaped guide for the hook-shaped end 40 is provided whereby a slot 43 is formed between the guide wall 44 and a bracket 45. The bracket 45 has at its inner side, i.e., oriented toward the slot 43, a cam 46 which will yield upon pivoting of the hook-shaped end 40 due to the spring-elastic properties of the bracket 45. The actuating button 3 comprises a circular arc segment-shaped guide element 47 whereby the width of the guide element corresponds to the width of the recess within the housing of the motor chainsaw and also a flat plate 48 extending substantially transverse to the guide element which in the represented arrangement of FIG. 1 is positioned directly above the upper side 10 of the housing 2.

Figure 5:
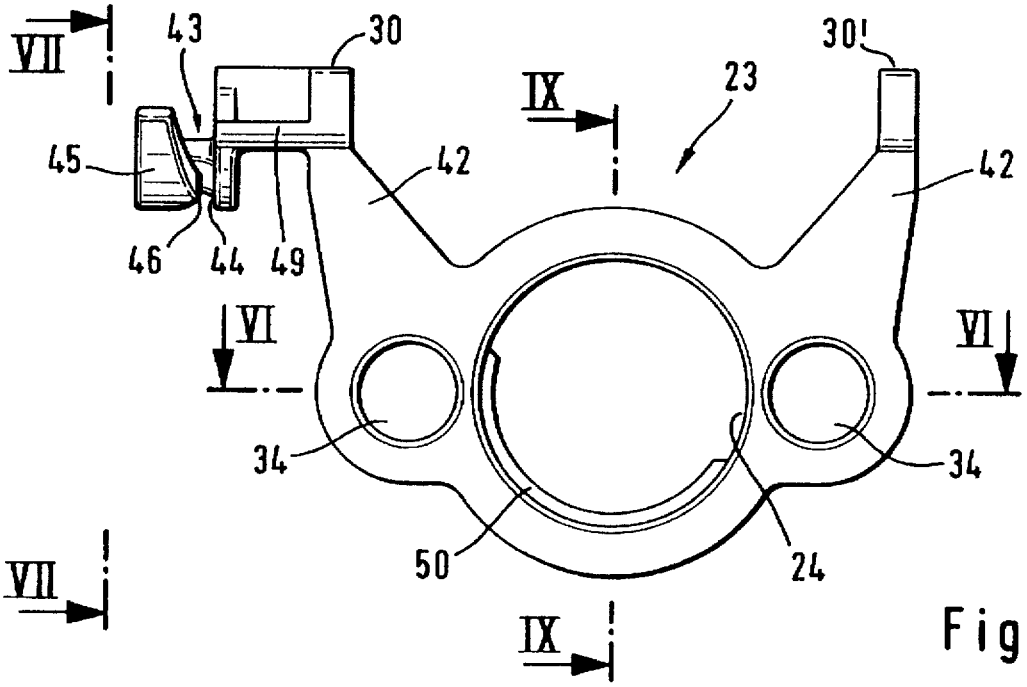
FIG. 5 shows a front view of the choke flange.

In FIG. 5 the front end of the choke flange 23 is shown. The bore 34 for receiving the fastening screws are located at opposite sides of the central opening 24. Above these bores 34 arms 42 extend substantially radially to the choke flange 23. At the ends of the arms 42 the shaft bearings 30, 30 are positioned. The shaft bearing 30 at the upper end of the arm 42 supports the side of the operating member 38 at which the hook-shaped end for engaging the lever of the choke flap shaft is provided. The upper end of the arm 42 has a support section 49 for the guide wall 44 and the bracket 45. The slot 43 is located between the guide wall 44 and the bracket 45. Along the circumferential edge of the central opening 24 a radially inwardly extending projection 50 is provided which extends over an annular section having an angular distance of less than 180°.

Figure 6:
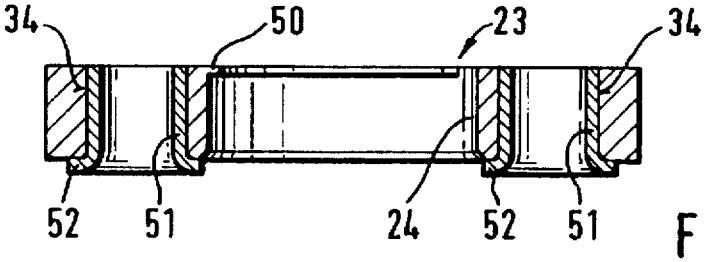
FIG. 6 shows a section along the line VI—VI of FIG. 5.

As can be seen especially well in FIG. 6, showing a section along the line VI—VI of FIG. 5, the projection 50 in the form of an annular collar is positioned at the side of the choke flange 23 facing the carburetor 16. The projection 50 serves thus as an abutment for the suction tube shown in FIG. 2 which is pressed into the central opening 24. In addition to the representation of FIG. 5 the section of FIG. 6 shows the support sleeves 51 which are introduced into the bores 34 and have a collar 52 resting at the front side of the choke flange 23. These support sleeves 51 are comprised of a material that has a much greater hardness than the material of the choke flange 23. They thus prevent the impact of pressing forces that are too great onto the material of the choke flange. Accordingly, the choke flange 23 is protected against destruction resulting from tightening the fastening screws with too great a torque.

From the representation in FIG. 7 it can be taken that the shaft bearing 30 and also the guide means for the hook-shaped end of the bracket is positioned in a plane displaced relative to the plane of the flange 23. This displaced plane, however, is in the vicinity of the plane of the choke flap shaft 21 or preferably coincides with it. This results in kinematic advantages for the transmission of the movement of the actuating button 3 into the movement of the choke flap shaft 21 (compare FIG. 4). The bracket 45 extends with a circular arc-shape about the center of the opening 29 of the shaft bearing 30.

Figure 8:
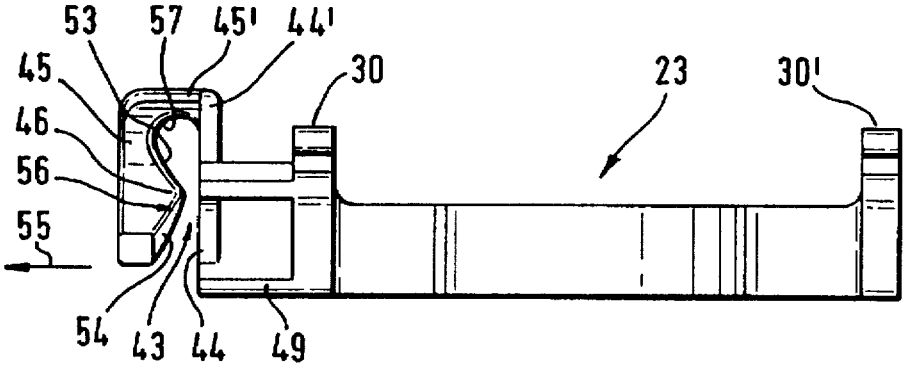
FIG. 8 shows a plan view of the component of FIG. 5.

As can be seen in FIG. 8, at the end of the support section 49 the guide wall 44 is provided. At the rearward end 44' thereof in the direction of flow of the combustion air, the base 45' of the bracket 45 is provided. The bracket 45 has a cam 46 at the side limiting the slot 43. The cam 46 has oppositely slanted surfaces 53, 54. Due to the design of the base 45' and the type of material used, the bracket 45 in its longitudinal direction is spring-elastic so that upon actuation of the operating member 38 the hook-shaped end glides along the slanted surface 53 so that the bracket 45 performs a movement in the direction of arrow 55. As soon as the hook-shaped end has traveled across the cam 46 and rests at the slanted surface 54, the bracket 45 is elastically returned so that the cam 46 engages from behind the hook-shaped end.

Due to the limitation of the rotational angle of the throttle valve defined within the carburetor, the maximal path of the hook-shaped end of the operating member is terminated at the point 56 of the support surface 54 so that the bracket 45 cannot completely return and the hook-shaped end is positioned close to the dead center of the cam 46. For returning the operating member there is only a minimal force required in order to pass across the cam 46 so that the hook-shaped end 40 is guided into a curved portion 57 formed in the vicinity of the base 45' of the bracket 45. The curved portion 57 is sized such that in this position which corresponds to the rest position of the choke flap, the bracket 45 is completely relaxed and unstressed.

FIG. 9 shows a section along the line IX—IX of FIG. 5. The section plane shows the central opening 24 having provided thereat the projection 50 at the lower circumferential edge. The arm 42 is positioned behind the sectional plane and projects past the actual flange ring whereby at the upper end of the arm 42 the shaft bearing 30' is arranged displaced relative to the plane of the flange.

In the embodiment shown, the cam 46 is formed at the bracket 45 and is thus spring-elastically supported. Alternatively, a cam can be arranged at the other shaft bearing 30' which is then oriented toward the actuating button 3. The spring elastic support can also be provided within the operating member as long as it is suitable with respect to design and material properties. In such a case the cam can be stationary.

Figure 10:
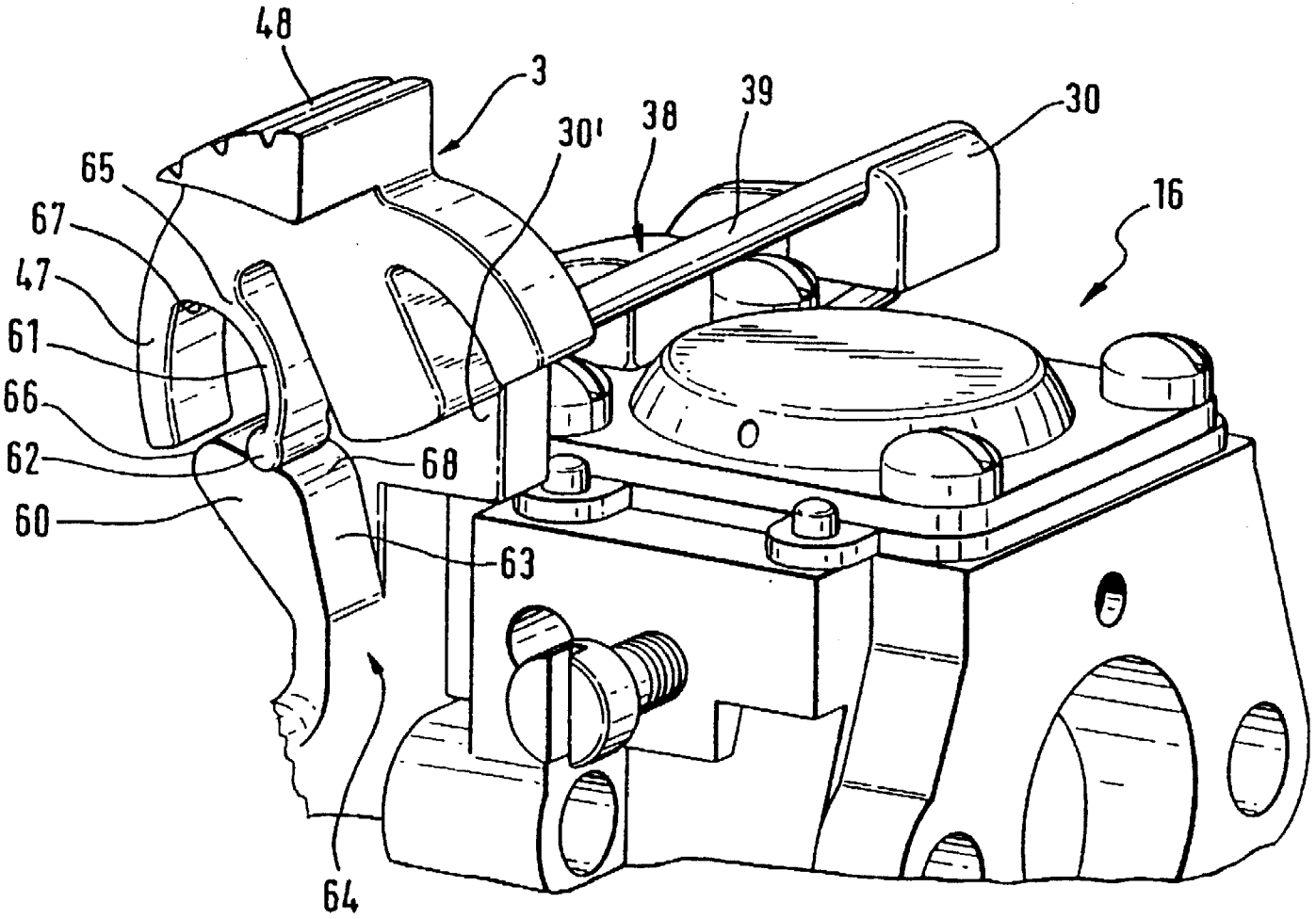
FIG. 10 shows a perspective representation of a further embodiment of the choke actuation.
Figure 11:
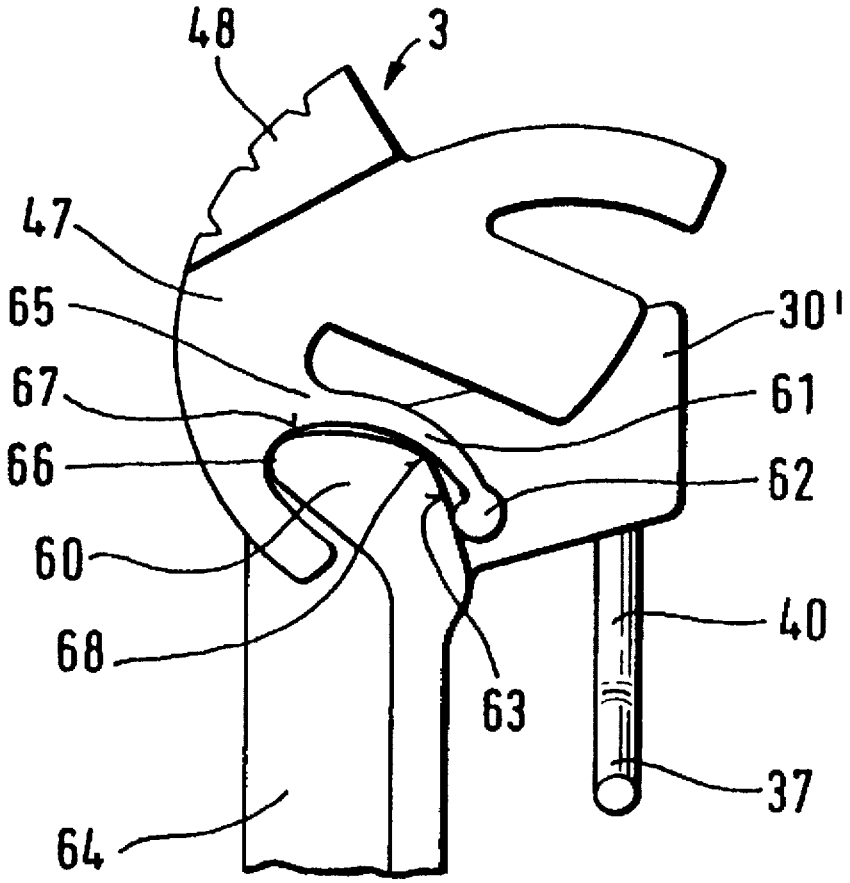
FIG. 11 shows a view in the direction of arrows XI in FIG. 10 but in an end position of the actuating button without the carburetor.

In the embodiment of FIGS. 10 and 11 a choke flange 64 consisting of metal is connected to the carburetor 16. The choke flange 64 comprises shaft bearings 30, 30' molded thereto in which the bracket 39 of the operating member 38 is received. In FIG. 11 the carburetor 16 is not represented so that the hook-shaped end 40 with its angular end 37 of the operating member 38 of FIG. 10 is visible. At the forward end of the bracket 39 the actuating button 3 is connected which comprises, as already disclosed in connection with the first embodiment, a guide element 47 and a plate 48.

A cam 60 is molded as a unitary part of the choke flange 64. The cam 60 has a slanted surface 63 extending on both sides of the zenith 68. The elastic bracket 61 slides on the surface 63 upon actuation of the actuating button 3. The elastic bracket 61 is formed as a unitary part of the actuating button and is embodied in the form of an elastic tongue. At the free end 62 with which the elastic bracket 61 glides on the surface 63, it is provided with a bead of a curved surface area. As can be seen in FIG. 11, the actuating button 3 is positioned in an end position whereby the elastic bracket 61 has engaged the cam 60 so that the free end 62 is positioned behind the zenith 68 of the surface 63. At the base 65 of the elastic bracket 61 an abutment surface 67 is provided at which the forward end 66 of the cam 60 comes to rest.

The present invention is, of course, in no way restricted to the specific disclosure of the specification and drawings, but also encompasses any modifications within the scope of the appended claims.

What I claim is:

1. A portable working tool comprising:

a housing;

an internal combustion engine, comprising a carburetor, contained in said housing;

a throttle valve connected to said carburetor;

a choke flap connected to said carburetor upstream of said throttle valve in a flow direction of the combustion air into said carburetor;

an operating member connected to said choke flap;

a choke flange connected to said carburetor at a side of said carburetor at which said choke flap is arranged;

a suction member for the combustion air connected to said choke flange;

said choke flange having a receiving element for said operating member;

a lever fixedly connected to said choke flap;

said operating member having a first end extending through said housing to the exterior and a second end engaging said lever;

an actuating button connected to said first end.

2. A working tool according to claim 1, wherein said receiving element is comprised of two shaft bearings spaced from one another and having a common bearing axis, wherein said bearing axis extends parallel to a face of said choke flange.

3. A working tool according to claim 1, wherein said operating member is a wire bracket formed by bending a wire.

4. A working tool according to claim 3, wherein said second end is hook-shaped.

5. A working tool according to claim 3, wherein said first end is bent and wherein said actuating button is comprised of plastic material and is connected positive-lockingly to said first end.

6. A working tool according to claim 3, wherein said wire bracket has a longitudinal axis and is pivotable about said longitudinal axis into two defined positions, wherein said working tool comprises securing elements for securing said wire bracket in said two defined positions.

7. A working tool according to claim 6, wherein said securing elements are arranged in the vicinity of said actuating button and are comprised of at least one non-elastic cam with a glide surface and at least one elastic bracket, wherein said elastic bracket slides along said glide surface of said cam.

8. A working tool according to claim 7, wherein said cam is stationary.

9. A working tool according to claim 7, wherein said cam is fixedly connected to said choke flange.

10. A working tool according to claim 9, wherein said cam and said choke flange are molded as a unitary part.

11. A working tool according to claim 7, wherein said elastic bracket and said actuating button are formed as a unitary part, said elastic bracket being an elastic tongue.

12. A working tool according to claim 11, wherein:

said elastic bracket has a base with which said elastic bracket is connected to said actuating button;

said cam has a forward end;

said base has an abutment surface for said forward end of said cam.

13. A working tool according to claim 6, wherein said securing elements are arranged at said second end and comprise at least one cam with oppositely extending slanted surfaces.

14. A working tool according to claim 13, further comprising a bracket to which said cam is connected, said bracket acting as a spring in the direction of said longitudinal axis of said wire bracket.

15. A working tool according to claim 14, wherein said choke flange, said receiving element, and said bracket with said cam form a unitary part comprised of plastic material.

16. A working tool according to claim 14, wherein said bracket has a curved portion and wherein said second end, when said choke flap is in a rest position, is received in said curved portion without mechanical loading of said bracket.

17. A working tool according to claim 14, wherein in an actuated position of said choke flap said second end is positioned on one of said oppositely extending slanted surfaces adjacent to a dead center of said cam.

18. A working tool according to claim 1, wherein:

said suction member is a suction tube:

said choke flange has a receiving opening; and said suction tube is axially pressed into said receiving opening for securing said suction tube to said choke flange.

19. A working tool according to claim 18, wherein said choke flange has a radially inwardly extending abutment connected to the inner circumference of said receiving opening at a side of said choke flange facing said carburetor.

20. A working tool according to claim 19, wherein said abutment is an annular segment extending over an angular distance of less than 180°.

21. A working tool according to claim 1, wherein said choke flange has at least two bores for receiving fastening screws.

22. A working tool according to claim 19, wherein said choke flange consists of polymethylene oxide, further comprising support sleeves inserted into said bores, wherein said support sleeves consist of a material that is of much greater hardness than polymethylene oxide.

* * * * *